US007841058B2

(12) United States Patent
Mayle

(10) Patent No.: US 7,841,058 B2
(45) Date of Patent: Nov. 30, 2010

(54) DEVICE AND METHOD FOR MAKING A ROOF FITMENT

(76) Inventor: Steven R. Mayle, 2274 August Dr., Fremont, OH (US) 43420

( * ) Notice: Subject to any disclaimer, the term of this patent is extended or adjusted under 35 U.S.C. 154(b) by 0 days.

(21) Appl. No.: 12/397,046

(22) Filed: Mar. 3, 2009

(65) Prior Publication Data

US 2010/0223879 A1 Sep. 9, 2010

(51) Int. Cl.
*B23Q 3/00* (2006.01)

(52) U.S. Cl. ..... 29/281.1

(58) Field of Classification Search ..... 29/281.1, 29/238, 239, 281.3, 283.5
See application file for complete search history.

(56) References Cited

U.S. PATENT DOCUMENTS

| | | | | |
|---|---|---|---|---|
| 6,709,543 | B2 * | 3/2004 | Kurosawa | 156/344 |
| 6,754,993 | B1 * | 6/2004 | Mayle et al. | 52/58 |
| 7,347,907 | B1 * | 3/2008 | Mayle et al. | 156/71 |
| 2002/0069952 | A1 * | 6/2002 | Kurosawa | 156/91 |

* cited by examiner

*Primary Examiner*—Lee D Wilson
(74) *Attorney, Agent, or Firm*—Standley Law Group LLP

(57) ABSTRACT

Exemplary embodiments generally relate to a method and device for assembling a plurality of different roof-covering membranes, herein known as fitments. The particular fitment is preferably designed for the particular roof on which it is to be used. The roof measurements may be provided to a factory which may create a unitary membrane from separate pieces which may be hot air bonded together. A single machine may be utilized to quickly, and repeatably assemble a plurality of different fitments.

20 Claims, 11 Drawing Sheets

DEVICE AND METHOD FOR MAKING A ROOF FITMENT

CROSS-REFERENCE TO RELATED APPLICATIONS

This application is a non-provisional patent application and does not claim priority to any co-pending applications.

TECHNICAL FIELD

Exemplary embodiments generally relate to a method and device for assembling a plurality of different roof-covering membranes, herein known as fitments. A single machine may be utilized to quickly, and repeatably assemble a plurality of different fitments.

BACKGROUND OF THE ART

Items such as vents, ductwork, air conditioning units, and the like commonly protrude from the surface of a roof. The size and location of these items is preferably provided to the factory which creates the membrane. With this information, the factory may make provisions for these items in the membrane.

Providing a water-tight seal around a protrusion in a roof presents a number of problems. U.S. Pat. No. 4,872,296 discloses a method and a fitment which have been used to cover the corners of protrusions. The fitment of this patent comprises a first generally rectangular member segment, a side being part-way split interjacent its ends, and a second member segment with a triangularly-shaped corner portion conformed to loop shape and having its marginal edges overlying portions of the first segment contiguous to the split and being welded thereto in a continuous weld seam. This method and fitment work best when the angle of the corner is a right angle and the angle between the roof and the protrusion is a right angle.

In many cases, however, the corner is not a right angle, the protrusion is not at a right angle to the roof, or there is some other irregularity in the protrusion, such as the bottom and the top being different sizes. In these situations, known fitments and methods do not provide satisfactory results. The membrane must be folded or "bunched" in order to conform the membrane to the underlying structure. The folding and bunching is unsightly, and water may collect in the folds which may have deleterious effects on the roofing membrane and/or may lead to localized leaks at seams and at other places in the membrane. In addition, folding can lead to cracking of the roof membrane over time due in part to stress induced by the fold lines. Therefore, a need exists for an adjustable fitment and roof membrane system that provides a smooth transition no matter what the shape or angle of the underlying protrusion and that eliminates the need to fold or bunch the fitment or the roof membrane.

U.S. Pat. No. 6,199,326 provides an embodiment of an adjustable roof membrane which includes a universal fitment. The disclosure of U.S. Pat. No. 6,199,326 is hereby incorporated by reference in its entirety. In this embodiment, the universal fitment is an adjustable corner fitment for a roof. The adjustable corner fitment is comprised of a top membrane and a bottom membrane. The top membrane has a cutout. The cutout extends from a side of the top membrane. The base membrane portion has a first side, a second side, a third side and a fourth side. The first side is connected to the second side at a first angle greater than 90 degrees, and the third side is connected to the fourth side at a second angle greater than 90 degrees. The base membrane portion is conformed to loop shape such that the first side and the second side underlie portions of the top membrane contiguous to the cutout. The first side of the base membrane may be completely welded to the top membrane prior to installation. However, the second side of the base membrane is adjustable relative to the top membrane prior to installation on the roof. Consequently, an installer is able to adjust the corner fitment to a corner in the field to eliminate unnecessary buckling of the corner fitment or the roof membrane. After adjusting the corner fitment to the corner, the installer may then completely weld the second side of the base membrane to the top membrane.

Further, U.S. Pat. Nos. 6,754,993 and 7,347,907 (both issued to Mayle et al.) disclose adjustable roof fitments and are herein incorporated by reference in their entirety. The fitments and methods for constructing the fitments disclosed in these patents are useful with roof membranes to cover exposed roof areas around a vertical protrusion in a roof. The fitments may be partially secured to a roof membrane, a boot, and/or a spanning strip prior to being positioned at the corner of a vertical protrusion. Alternatively, the fitment may be positioned independently of the other components at the corner of a vertical protrusion. After the fitment is positioned at the corner of a vertical protrusion, a floating portion of the fitment may be adjusted to fit the corner of the vertical protrusion so that there is minimal or no folding or bunching of the material of the fitment. In this adjusted position, the floating portion of the fitment may be dielectically welded, hot air bonded or otherwise secured to another portion of the fitment, and the fitment may be finally dielectrically welded, hot air bonded or otherwise secured to the roof membrane, the boot, and/or the spanning strips.

These prefabricated roofing fitments may be made from thermoplastic olefin (TPO), polyvinyl chloride (PVC), or any other suitable material. TPO material is much less expensive than other roof membrane material, but has not been used in the roofing industry in the past because TPO is non-conductive material and therefore, cannot be dielectrically welded. Material such as polyvinyl chloride (PVC) has been commonly used in the roofing industry since it can be easily dielectrically welded. However, PVC is much more expensive than TPO. Accordingly, PVC lends itself to dielectric welding or hot air bonding, while TPO lends itself to hot air bonding. With the hot air bonding apparatus and methods of the exemplary embodiment a fully TPO fitment is achieved.

An exemplary embodiment may utilize any material suitable for constructing the fitments described herein. Examples of the materials utilized in the fitments may be comprised of polyvinyl chloride (PVC), thermoplastic olefin (TPO), or rubber, and any mixtures thereof. The fitments may be made from or use any material that is heat bondable, glue bondable, or solvent bondable. The fitments may be made with or use a material that is compatible with dielectric welding, hot air bonding, solvent fusion, adhesive bonding, heat welding, melt bonding, vibration welding, ultrasonic welding, heat staking, or other methods commonly known to those experienced in the field of this art.

In addition to the novel features and advantages mentioned above, other objects and advantages are achieved, at least in the preferred embodiments, by the invention as shown and described below.

SUMMARY OF THE EXEMPLARY EMBODIMENTS

Exemplary embodiments relate to a device and method for constructing the roof fitments described herein. Embodiments provide a repeatable and efficient method for producing consistent roof fitments. The same base device may be used to create a plurality of different styles and shapes of fitments.

The foregoing and other features and advantages of the present invention will be apparent from the following more detailed description of the particular embodiments of the invention, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
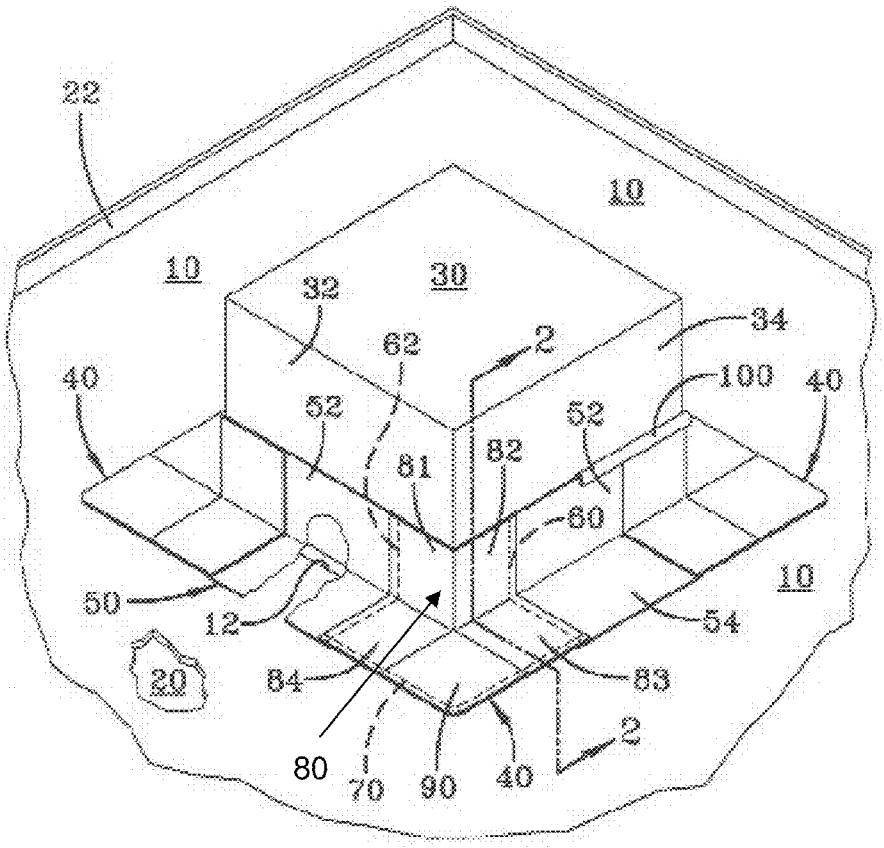
FIG. 1 is a perspective view of an embodiment of an adjustable roof membrane system.
Figure 2:
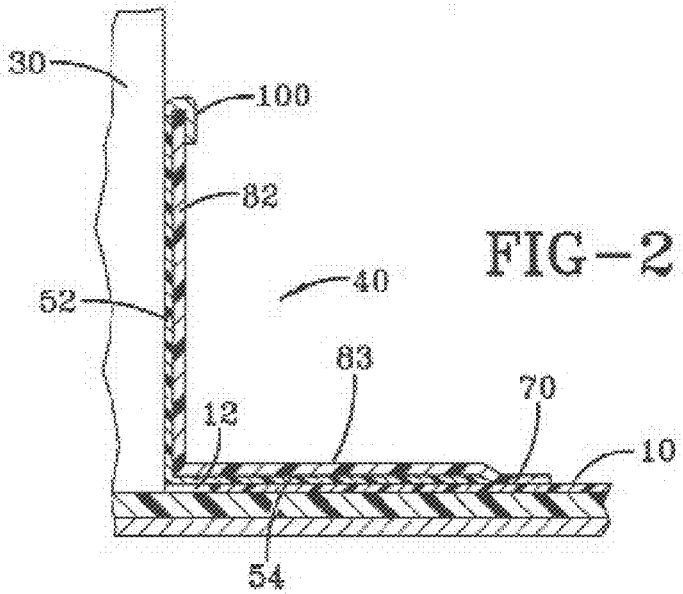
FIG. 2 is a cross sectional view taken along line 2-2 of FIG. 1.

Referring first to FIGS. 1 and 2, a polymer-membrane 10 is shown overlying a roof 20. The roof 20 may have a surrounding parapet 22. In addition, a protrusion 30 may extend from the roof 20. An opening 12 in the membrane 10 preferably allows the sides 32, 34 of the protrusion 30 to extend through the membrane 10. After the membrane 10 is in place on the roof 20, a preferred embodiment of a fitment 40 may be installed to substantially prevent moisture from entering the roof 20 at a corner of the protrusion 30.

In one type of adjustable roof membrane system, fitments 40 may be joined by spanning strips 50 as shown in FIG. 1. Each spanning strip 50 preferably has an upper portion 52 and a bottom portion 54. The bottom portion 54 may be dielectrically welded, hot air bonded or otherwise sealed along its length to the membrane 10, and the fitments 40 may be dielectrically welded, hot air bonded or otherwise sealed to the membrane 10 and the spanning strips 50 as shown at 60, 62, and 70. Although not shown in the figures, it should also be recognized that the fitments 40 may be positioned at the corners of a vertical protrusion such that they are overlapped by the spanning strips 50.

Figure 4:
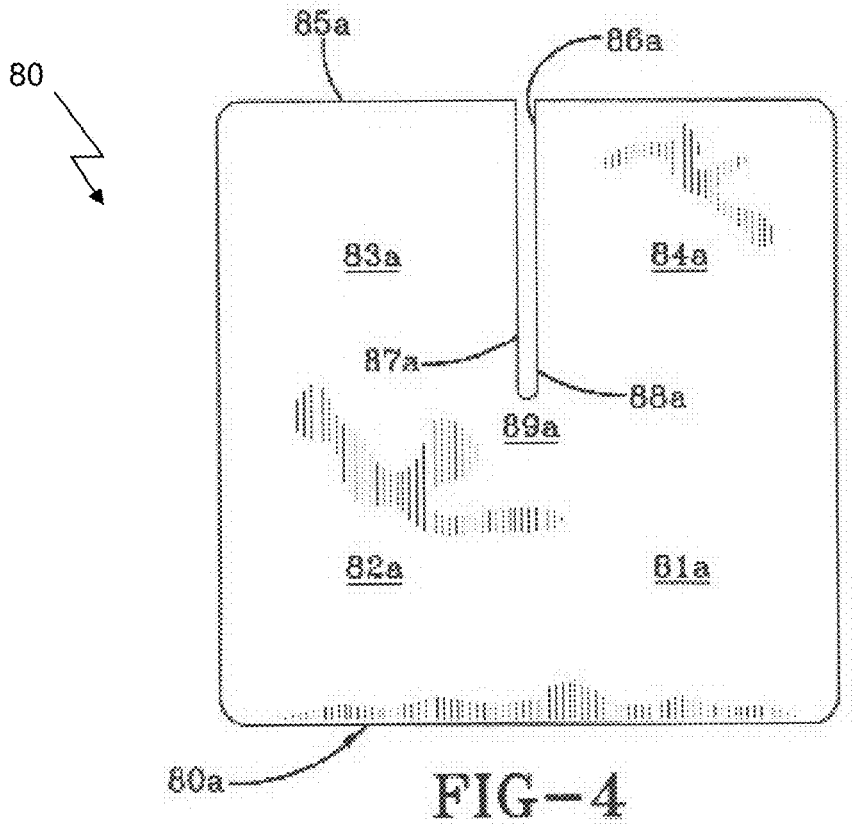
FIG. 4 is a top plan view of an exemplary embodiment of a top membrane portion.

A fitment 40 preferably has a top membrane portion 80 and a base membrane portion 90. As illustrated in FIG. 4, the top membrane portion 80 is preferably substantially rectangular and may be comprised of quadrants 81, 82, 83, and 84. The top membrane portion 80 has a cutout 86. The cutout 86 preferably divides quadrant 83 from quadrant 84, and it preferably extends from about the middle of side 85 to about the center portion 89 of the top membrane portion 80. As shown in FIG. 4, the cutout 86 may have substantially parallel sides 87, 88. For one example of the cutout 86, the sides 87, 88 may be separated by about one-half inch. However, the cutout 86 may increase in width as the cutout 86 extends from the center portion 89 towards the side 85.

In addition to the embodiment shown in FIG. 4, the top membrane portion 80 may take the form of many different shapes. The shape of the top membrane portion 80 may vary depending on the application. For example, the top membrane portion 80 may have a different number of sides, it may have curved sides, or it may have sides of different lengths. For another example, the cutout 86 may extend from a portion of a side other than the middle, it may extend at an angle which is not perpendicular, or it may have a different shape, length, or width.

Referring back to FIG. 1, quadrants 81, 82 of the top membrane portions 80 and upper portions 52 of the spanning strips 50 may be secured by an adhesive or other suitable means to the sides 32, 34 of the protrusion 30. A band 100 may be used to join the top edges of quadrants 81, 82 and upper portions 52. In addition, an adhesive, a bead of mastic, a bead of sealant, or any similar material may be used to form a tight seal between the band 100 and the sides 32, 34 of the protrusion 30.

Figure 3A:
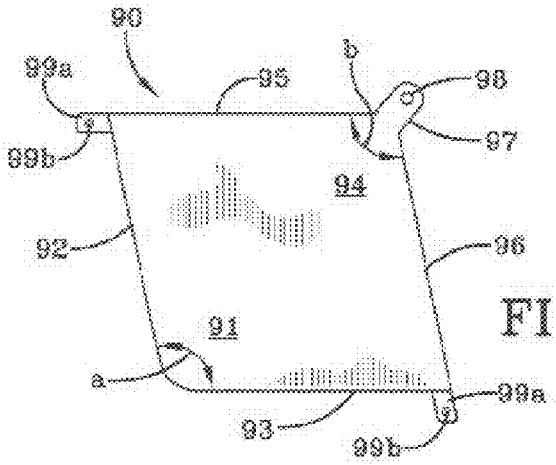
FIG. 3A is a top plan view of an exemplary embodiment of a base membrane portion.

Referring to FIG. 3A, the base membrane portion 90 is preferably comprised of a first generally triangular portion 91, a second generally triangular portion 94, and a tab 97 which has a hole 98. Sides 92, 93 of the first generally triangular portion 91 are preferably joined at a radiused corner. In addition, sides 92, 93 extend at an angle a which is greater than about 90 degrees. On the other hand, sides 95, 96 of the second generally triangular portion 94 are connected by the tab 97. The sides 95, 96 extend at an angle b which is greater than about 90 degrees. By making the angles a, b greater than about 90 degrees, the fitment 40 is preferably adjustable. In other words, the angles a, b preferably help to substantially eliminate the need to fold or bunch the fitment 40 when the corner is not a right angle, when the protrusion 30 is not at a right angle to the roof 20, or when there is some other irregularity in the protrusion 30.

However, the base membrane portion 90 is not limited to the configuration as described above. The base membrane portion 90 may have any other shape that is suitable and may have side tabs 99*a*, which may have a hole 99*b*, on the corner between side 92 and side 95 and/or the corner between side 93 and side 96.

Figure 3B:
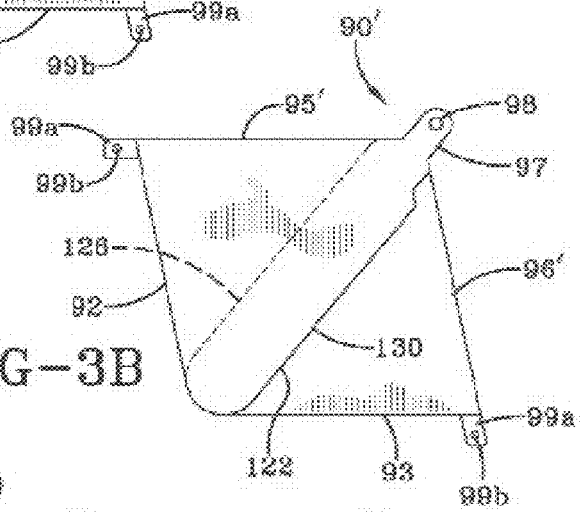
FIG. 3B is a top plan view of an exemplary embodiment of a base membrane portion which has a middle adjustment feature.
Figure 3C:
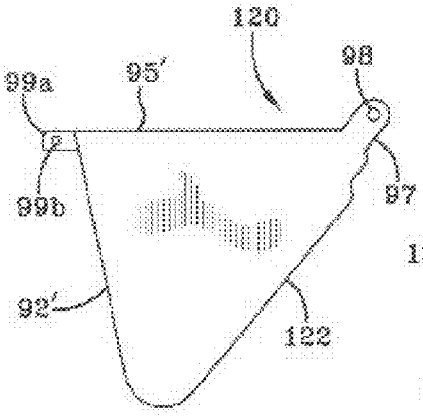
FIGS. 3C and 3D are top plan views of an embodiment of the two components that form the base membrane portion with a middle adjustment feature of FIG. 3B.
Figure 3D:
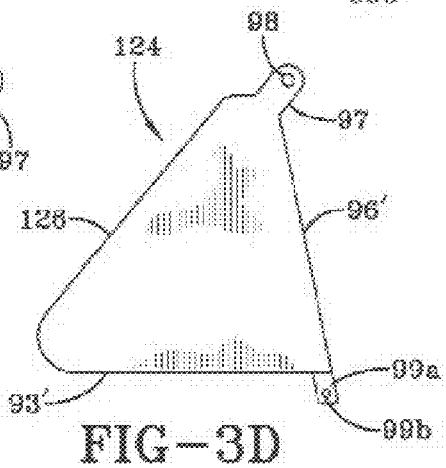

Referring now to FIGS. 3B-3D, in another embodiment the base membrane portion 90' may be comprised of two separate triangular shaped portions 120, 124. The first triangular shaped portion 120 may preferably be comprised of three sides 95', 92', 122, a tab 97 which may have a hole 98, and a side tab 99*a* which may have a hole 99*b*. Side 95' and side 122 are preferably connected by a tab 97, while side 95' and side 92' are preferably connected by a side tab 99*a*. The second triangular shaped portion 124 may preferably be comprised of three sides 96', 93', 126, a tab 97 which may have a hole 98, and a side tab 99*a* which may have a hole 99*b*. Side 96' and side 126 are preferably connected by a tab 97, while side 96' and side 93' are preferably connected by a side tab 99*a*. In an exemplary embodiment, the first triangular shaped portion 120 and the second triangular shaped portion 124 are arranged to form a base membrane portion 90'.

The base membrane portion 90' may be substantially similar to base membrane portion 90. However, base membrane portion 90' has a middle adjustment feature 130 which allows the fitment 40 to be adjusted when sides 95' and 96' are sealed to the top membrane portion 80. The middle adjustment feature 130 is preferably formed by the overlapping of side 122 on the first triangular shaped portion 120 and side 126 on the second triangular shaped portion 124.

Figure 5A:
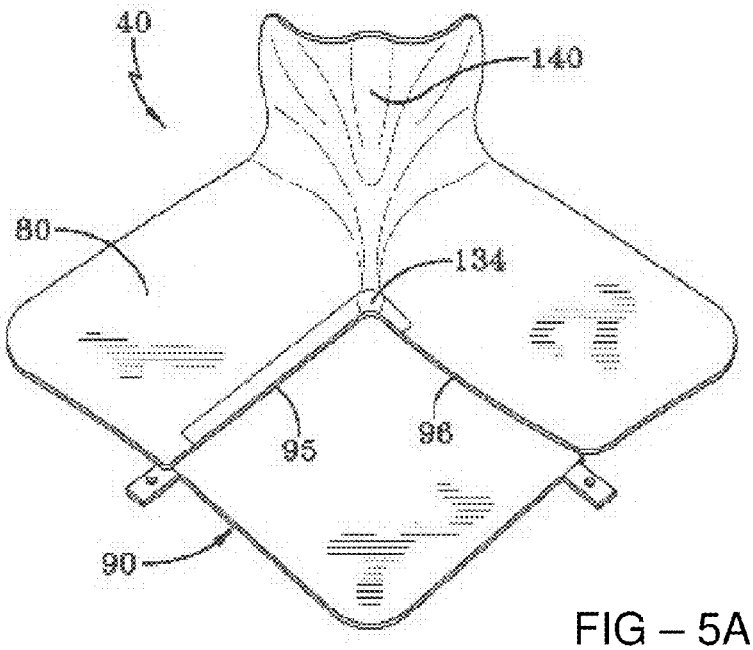
FIG. 5A is a perspective view of an assembled fitment which lacks a seal along at least a portion of one of its edges.
Figure 5B:
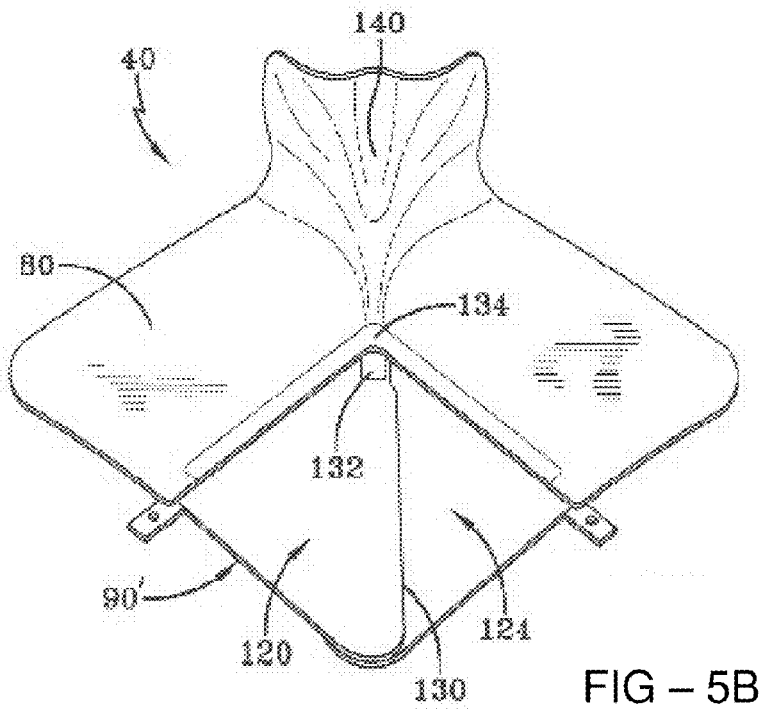
FIG. 5B is a perspective view of an assembled fitment which has both edges completely sealed.

FIGS. 5A and 5B show examples of fitments 40 prior to installation. In an exemplary embodiment, preferably only one of the sides 95, 96 may be completely sealed to the top membrane portion 80 prior to installation on the roof 20. Preferably, only a portion, if any at all, of the other side 95, 96 may be sealed to the top membrane portion 80 prior to installation. This preferably enables the fitment 40 to be adjusted in the field to a corner that is not a right angle, a protrusion 30 that is not at a right angle to a roof 20, and/or an irregularly-shaped protrusion 30. In a fitment 40 that has a middle adjustment feature 130, both sides 95' and 96' may be sealed to the top membrane portion 80 prior to installation. However, the middle adjustment feature 130 is not sealed prior to installation and enables the fitment 40 to be adjusted in the field to the corner or protrusion 30 on the roof 20. It should be noted that after sealing, the base membrane portion 90 remains substantially flat.

Although it may be advantageous to leave one of the sides 95 or 96 unsealed or provide an adjustment feature 130, these are not required. Exemplary fitments may lack an adjustment feature 130 and may be completely sealed on both sides 95 and 96. An exemplary device for making the fitments disclosed herein would be capable of manufacturing each type of sealing arrangements for the various fitments.

During installation, after the fitment 40 is adjusted to the roof 20 and to the protrusion 30 in the field to substantially eliminate any folding or bunching, if there is an unsealed side, the unsealed side 95 and/or 96 may be sealed along its entire length to the top membrane portion 80 or the middle adjustment feature 130 may be sealed.

Figure 6:
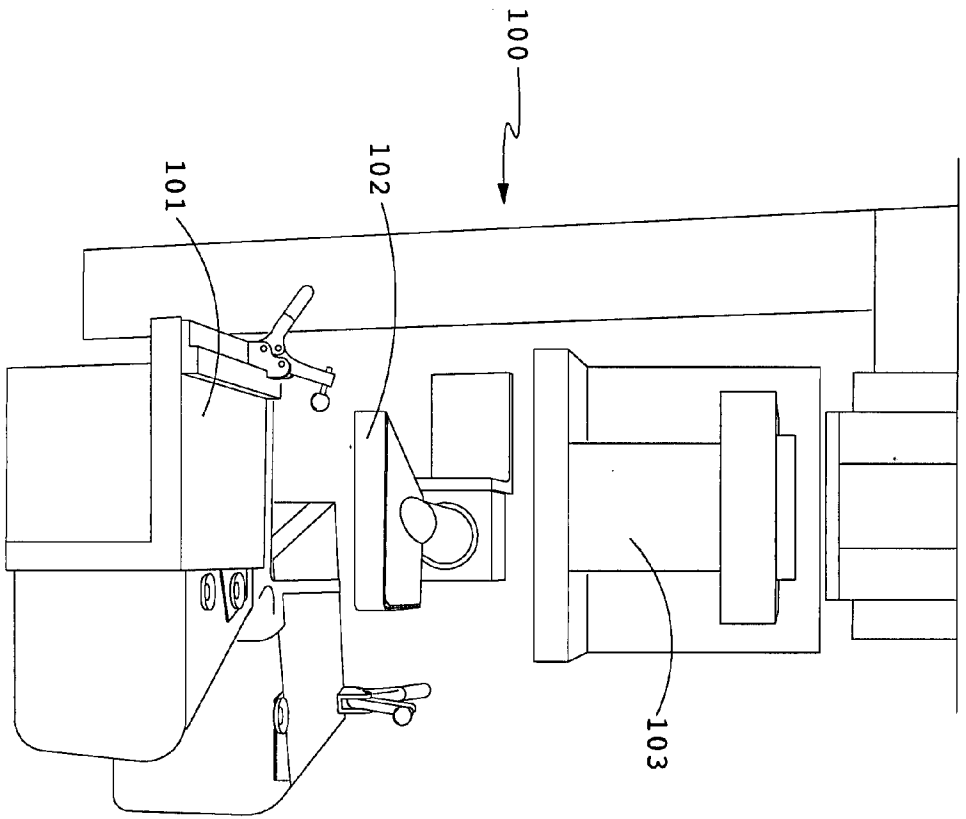
FIG. 6 is a perspective view of an exemplary embodiment of a device for manufacturing roof fitments.

FIG. 6 shows an exemplary device 100 for making the various fitments described herein. An exemplary device may be comprised of a ram 103, bolster plate 101, and heating element 102.

Figure 7:
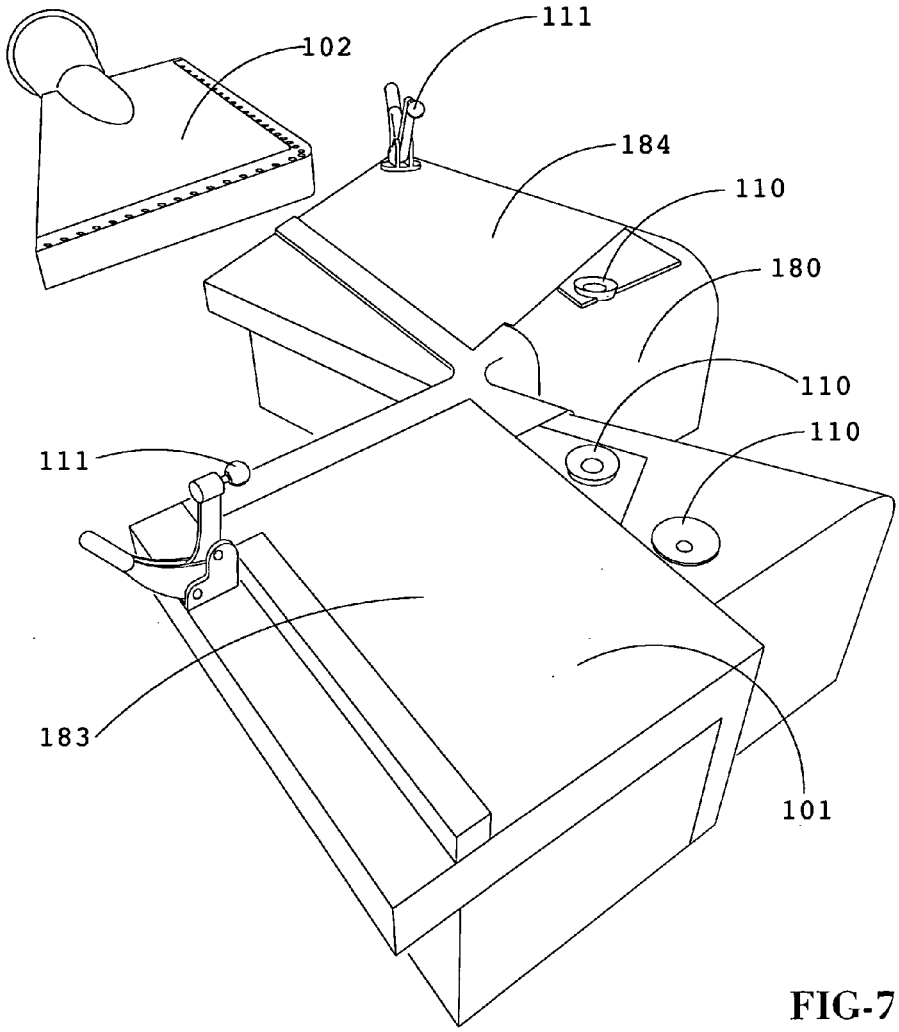
FIG. 7 is a perspective view of an embodiment for the bolster plate and heating element.

FIG. 7 provides another view of the bolster plate 101 and heating element 102. The bolster plate 101 contains one or more securing mechanisms 111 along with one or more suction devices 110; both elements may be used to hold the top membrane portion 80 in position during the fabrication process. Alternatively, only securing mechanisms or only suction devices may be used to secure the top membrane portion. The bolster plate 101 has three main surface areas. First area 183 accepts quadrant 83 of the top membrane portion 80. Second area 184 accepts quadrant 84 of the top membrane portion 80. Third area 180 accepts quadrants 82 and 81 of the top membrane portion 80.

Figure 8:
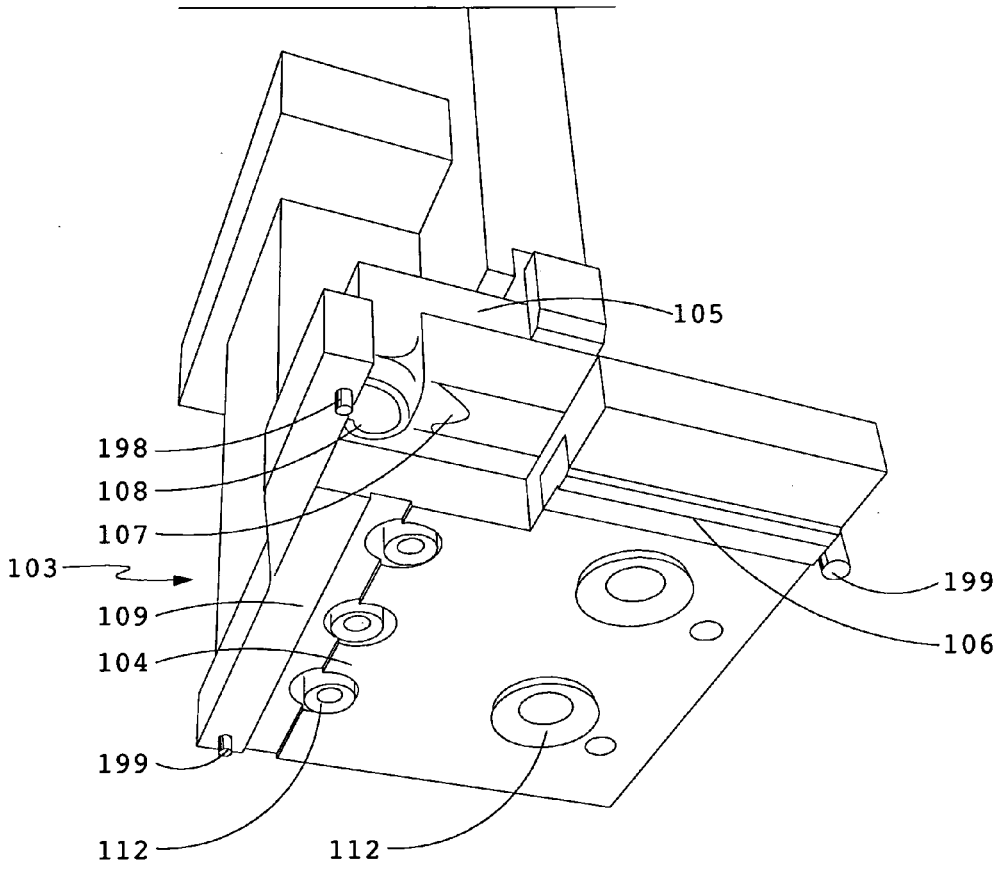
FIG. 8 is a perspective view of the bottom surface of the ram, showing the first and second dies.

FIG. 8 provides a detailed view of the bottom surface of the ram 103, which contains a first die 104 and a second die 105. The first die 104 is actuated by the main ram actuator assembly 200 (see FIG. 11B) and the second die 105 is actuated by an auxiliary actuator assembly 201 (see FIG. 11B). The ram 103 may contain one or more suction devices 112 and pins 198 and 199 for securing the bottom membrane portion 90 during fabrication of the fitment. In alternative embodiments, only suction devices or only pins may be used. Hole 98 in the bottom membrane portion corresponds to pin 198 in the ram while holes 99*b* in the bottom membrane portion correspond with pins 199 in the ram.

The first die 104 is utilized to create a seal along edge 95 and at least a portion of 96. Edge feature 109 is contained within the first die 104 and is used to create a seal along edge 95. A portion of the first die 104 may comprise an insert 106, so that the same die may be used to create both fitments where the entire edge 96 is sealed and also where only a portion of the edge 96 is sealed. By changing out the insert 106, the points of contact between the first die 104 and the bolster plate 101 may be changed without having the change the entire die or use an entirely different machine. The second die 105 contains an edge feature 107 to further seal at least a portion of edge 96. The second die 105 also contains a concave feature 108 which interfaces with third area 180 of the bolster plate 101. The concave feature 108 is used to form the seal around radius 134 to create pucker 140.

Figure 9:
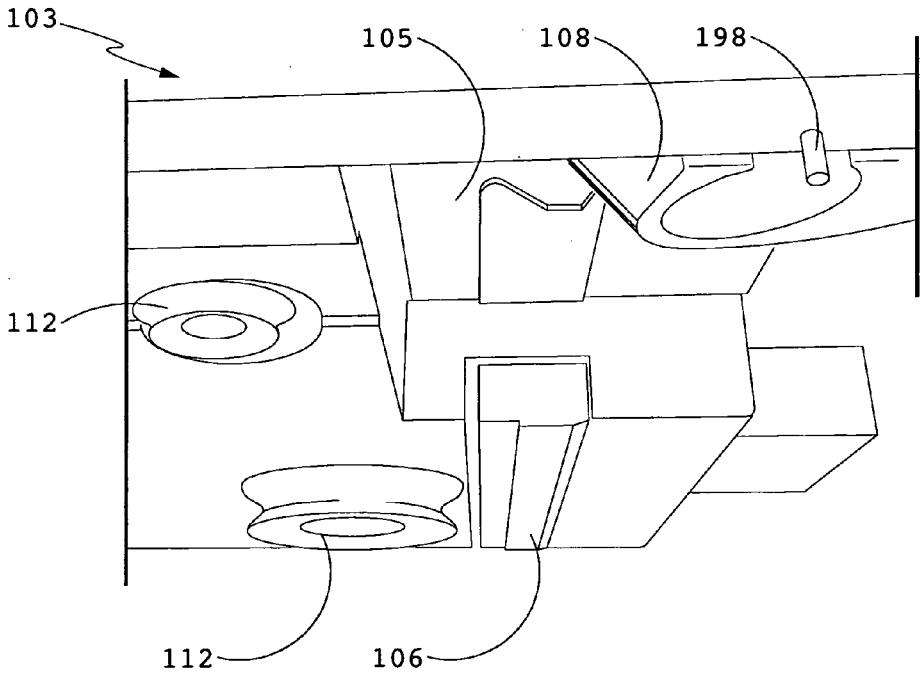
FIG. 9 is another perspective view of the bottom surface of the ram, showing the insert.

FIG. 9 is another view of the bottom surface of the ram 103. Suction devices 112 are again shown along with insert 106. Also shown is the second die 105 which contains the concave feature 108 and pin 198.

Figure 10A:
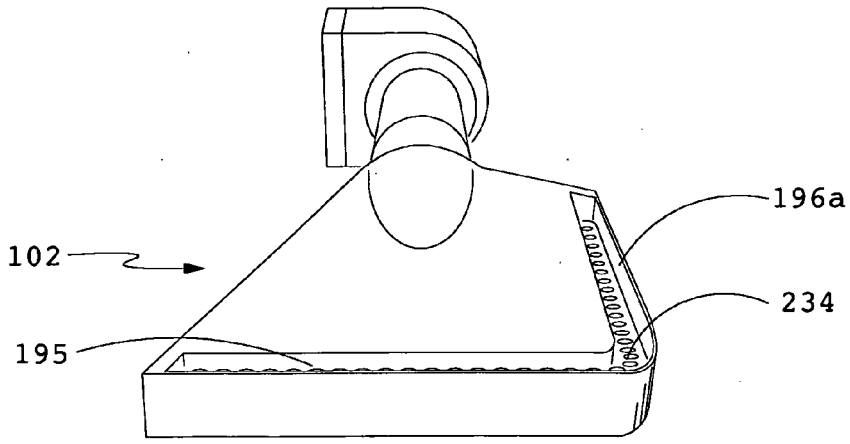
FIGS. 10A and 10B are perspective views of alternative embodiments of the heating element.
Figure 10B:
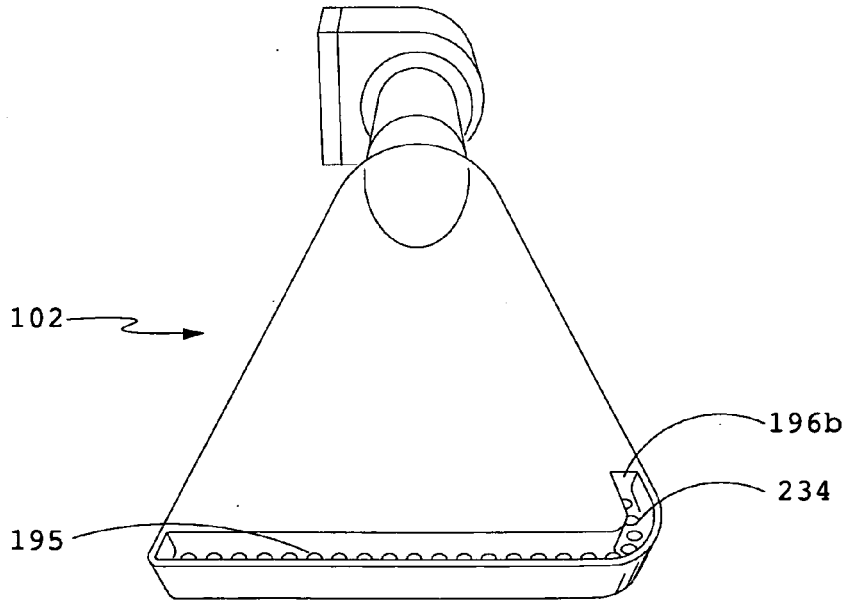

FIGS. 10A and 10B show two embodiments for the heating element 102. These embodiments may be utilized when hot air bonding is the chosen method for creating the seals between the base 90 and top 80 membrane portions. For the embodiment shown in FIG. 10A, air exhausts are located along edges 195 and 196*a*, along with radius 234. For the embodiment shown in FIG. 10B, air exhausts are located along edges 195 and 196*b*, along with radius 234. As can be observed, edge 196*b* does not run the length of the heating element, where 196*a* from FIG. 10A does. Thus, the embodiment shown in FIG. 10B would be utilized when the entirety of edge 96 between the membranes is not required to be sealed. Both embodiments may force hot air over the overlapping areas of edges 96, 95, and radius 134. As shown below, the heating element 102 is sandwiched between the base 90 and top 80 membrane portions prior to contacting the portions with one another. Thus, an exemplary device would force hot air in both the upward and downward directions in order to heat the overlapping edges of both the base 90 and top 80 portions simultaneously.

An exemplary method for making a fitment may begin by placing the top membrane portion 80 on the bolster plate 101 and placing the base membrane portion 90 on the bottom surface of the ram 103. The top membrane portion 80 may be secured in place by using one or more securing mechanisms 111 along with one or more suction devices 110. The base membrane portion 90 may be secured in place by using one or more suction devices 112 and pins 198 and 199. When securing the top membrane portion 80 to the bolster plate 101, the quadrants of the membrane and bolster plate should preferably be aligned as described above. First area 183 accepts quadrant 83 of the top membrane portion 80. Second area 184 accepts quadrant 84 of the top membrane portion 80. Third area 180 accepts quadrants 82 and 81 of the top membrane portion 80. Third area 180 is a concave surface and when aligning the top membrane portion 80, the quadrants 82 and 81 should follow the surface without substantial wrinkles or buckles. The edges 87 and 88 of the top membrane portion 80 should be aligned so that when the ram 103 lowers, these edges overlap edges 95 and 96 of the base membrane portion 90.

Figure 11A:
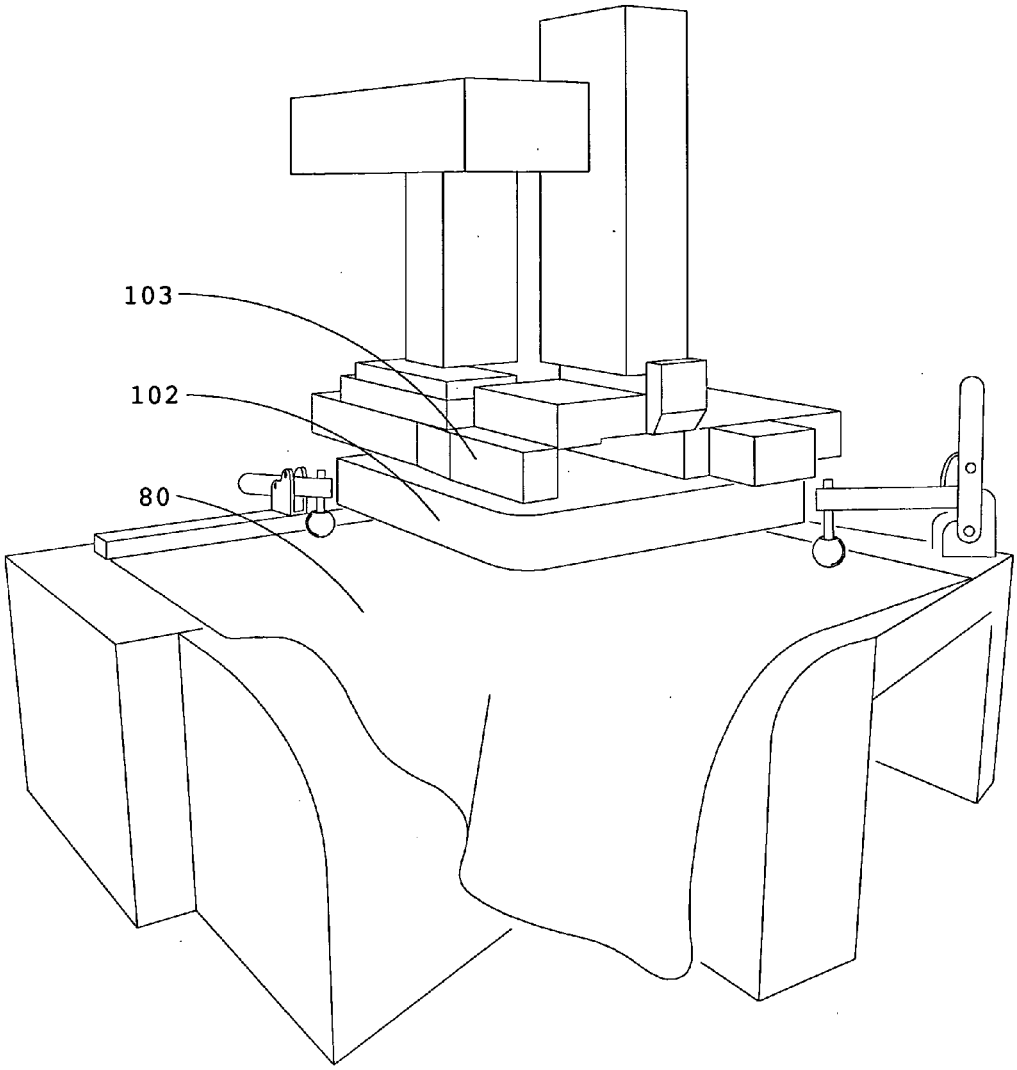
FIG. 11A is a perspective view of an exemplary device for assembling roof fitments, where the heating element is transferring heat to the two membrane portions.

Once the membrane portions are properly placed and secured, FIG. 11A shows what may be the next step in an exemplary process. The ram 103 is lowered so that the two membrane portions are in relatively close proximity to one another. The heating element 102 is placed between the two membrane portions and forces hot air along the seams which are to be sealed. Preferably, the heating element forces hot air along the seam areas of both the top and base membrane portions 80 and 90 respectively. As noted above, a plurality of different heating elements 102 may be interchangeable with an exemplary device so that a single device is capable of making a plurality of different fitments.

Figure 11B:
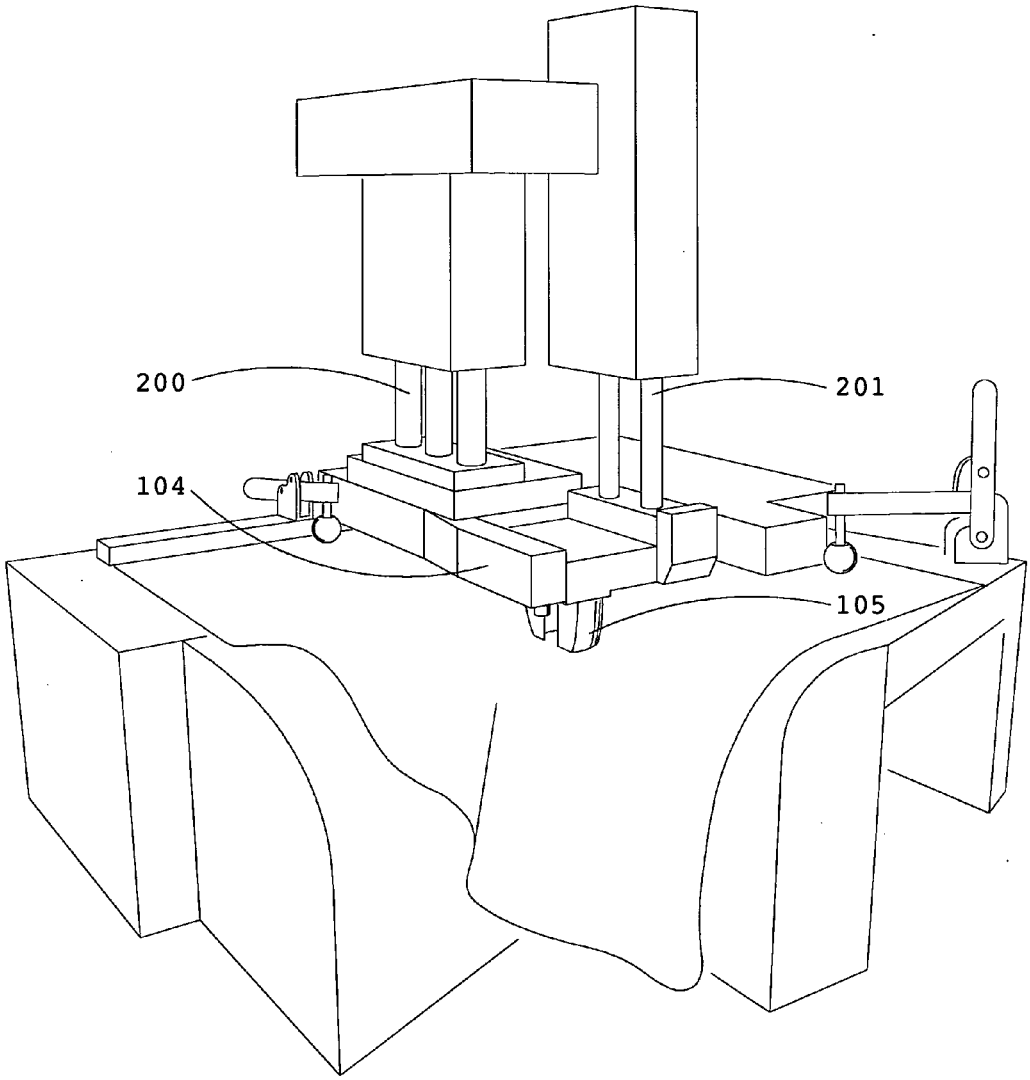
FIG. 11B is a perspective view of the embodiment shown in FIG. 11A where the heating element has been retracted and the first and second dies are pressing overlapping portions of the membranes together.

Once the membrane portions are adequately heated, FIG. 11B shows what may be the next step in an exemplary process. The heating element 102 is removed and the ram 103 is further lowered so that the membrane portions are adjacent to one another. For sealing the desired edges, the ram 103 lowers the first 104 and second dies 105 so that pressure is created along the desired edges which were previously heated by the heating element 102. In an exemplary embodiment, the pressure is created through two actuations. The first die 104 is actuated first by the main ram actuator assembly 200 and then the second die 105 is actuated by an auxiliary actuator assembly 201. However, one continuous actuation may be used.

In a preferred embodiment, the first die 104 is used to create the seal along edges 95 and 96, while the second die 105 is used to create the seal near the radius 134 and possibly a portion of edges 95 or 96. As noted above, the second die 105 contains a concave feature 108 which interfaces with third area 180 of the bolster plate 101. The concave feature 108 is used to form the seal around radius 134 to create pucker 140.

As noted above, an insert 106 may be used so that a plurality of edge-seal orientations may be accomplished through the same machine. Thus, both edges 95 and 96 may be sealed, only a portion of each edge may be sealed, edge 95 may be sealed while only a portion of edge 96 is sealed, edge 96 may be sealed while only a portion of edge 95 is sealed, or any other combination. Thus, inserts may be used more places and with different geometry than the insert shown in FIGS. 8 and 9.

In exemplary embodiments, the fitment 40 may be made from thermoplastic olefin (TPO), polyvinyl chloride (PVC) and any other suitable material. TPO material is much less expensive than other roof membrane material, but has not been used in the roofing industry in the past because TPO is non-conductive material and therefore, cannot be dielectrically welded. Material such as polyvinyl chloride (PVC) has been commonly used in the roofing industry since it can be easily dielectrically welded. However, PVC is much more expensive than TPO. TPO material may be used because it may be easily and efficiently hot air bonded to form a seal, as described above. Additionally, using TPO material greatly reduces the cost associated with the adjustable fitments and roof membrane system. PVC material may be because it may easily be dielectrically welded or hot air bonded. Accordingly, PVC and any other suitable material may be used in the method(s) of forming a fitment 40 that use dielectric welding or hot air bonding, while TPO and any other suitable material may be used in the method(s) of forming a fitment 40 that use hot air bonding.

PVC, TPO and other suitable material may be used when the assembly of the component portions of the fitment 40 uses a mode for attachment other than hot air bonding and dielectric welding, such as caulking or adhesives.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

The invention claimed is:

1. A device for assembling roof fitments comprising
a bolster comprising:
two substantially flat areas,
a curved area, and
one or more securing mechanisms;
a ram located above said bolster and comprising:
a first die controlled by a main ram actuator assembly,
a second die having a concave feature corresponding to the curved area of the bolster and controlled by an auxiliary actuator assembly; and
one or more suction devices on the first die; and
a horizontally-retractable heating element between said bolster and said ram.

2. The device from claim 1 further comprising:
one or more suction devices on the two substantially flat areas of the bolster.

3. The device from claim 1 further comprising:
one or more locating pins on the first die of the ram.

4. The device from claim 1 further comprising:
a plurality of hot air exhausts along said heating element.

5. The device from claim 1 further comprising:
one or more inserts on the first die.

6. The device from claim 5 wherein:
the inserts are interchangeable with other inserts of varying geometries.

7. The device from claim 1 wherein:
the heating element is interchangeable with other heating elements of varying geometries.

8. A method for assembling a roof fitment comprising the steps of:
1. placing a top membrane portion on a bolster plate;
2. placing a base membrane portion on the bottom surface of a ram having an insert, wherein at least a portion of said top and base membranes overlap each other and also a portion of the insert;
3. holding said top membrane portion in place using one or more securing mechanisms;
4. holding said bottom membrane portion in place using one or more suction devices;
5. forcing hot air over the overlapping areas of both the top and base membranes; and
6. pressing at least a portion of the overlapping membrane areas together.

9. The method from claim 8 wherein the step of holding the bottom membrane portion in place further comprises the step of:
holding the bottom membrane portion in place using one or more locating pins.

10. The method of claim 8 wherein the step of holding the top membrane portion in place further comprises the step of:
holding the top membrane portion in place using one or more suction devices.

11. The method of claim 8 wherein the step of pressing at least a portion of the overlapping membrane areas together further comprises the steps of:
aligning edge features of the ram with the overlapping membrane areas; and
compressing the overlapping membrane areas between the bolster and the edge features of the ram.

12. The method of claim 11 further comprising the step of:

pressing a concave feature of the ram into a corresponding curved area of the bolster.

13. The method of claim 8 further comprising the steps of:

removing the assembled roof fitment;

replacing the insert with a second insert having different geometry;

placing a second top membrane portion on the bolster plate;

placing a second base membrane portion on the bottom surface of the ram containing the second insert, wherein at least a portion of the second to and second base membranes overlap each other and also a portion of the second insert;

holding the second to membrane portion in place using one or more securing mechanisms;

holding the second bottom membrane portion in place using one or more suction devices;

forcing hot air over the overlapping areas of both the second top and second base membranes; and pressing at least a portion of the overlapping membrane areas together.

14. A device for assembling roof fitments comprising a stationary bolster having:

two substantially flat areas, a curved area, a plurality of suction devices, and one or more securing mechanisms;

a ram located above said bolster and comprising:

a first die having one or more inserts and controlled by a main ram actuator assembly, and a second die controlled by an auxiliary actuator assembly; and a horizontally-retractable, interchangeable heating element between said bolster and said ram, said heating element having a plurality of hot air exhausts facing both the bolster and the ram.

15. The device of claim 14 further comprising:

a concave feature on the second die, said concave feature corresponding to the curved area of the bolster.

16. The device of claim 15 further comprising:

one or more suction devices on the first die of the ram.

17. The device of claim 16 further comprising:

one or more locating pins on the first die of the ram.

18. The device of claim 16 wherein:

the main ram actuator assembly and auxiliary actuator assemblies are capable of separate actuations.

19. The device of claim 16 wherein:

one or more inserts of varying geometries may be substituted for one another out of the ram.

20. The device of claim 16 wherein:

the main ram actuator assembly and auxiliary actuator assemblies are capable of a substantially continuous actuation.

* * * * *